United States Patent [19]

Huckle

[11] Patent Number: 4,618,070

[45] Date of Patent: Oct. 21, 1986

[54] INJECTION MOULDED SHUTTER

[75] Inventor: Ralph E. Huckle, Chichester, England

[73] Assignee: De La Rue Systems Limited, Portsmouth, England

[21] Appl. No.: 655,505

[22] Filed: Sep. 27, 1984

[51] Int. Cl.[4] ..... B65D 43/14; E06B 9/14

[52] U.S. Cl. ..... 220/350; 160/232; 160/235; 217/62; 312/138 R; 312/297

[58] Field of Search ..... 217/62; 220/350; 160/232, 235; 312/297, 138 R, 209

[56] References Cited

U.S. PATENT DOCUMENTS

| | | | |
|---|---|---|---|
| 769,423 | 9/1904 | Wilson | 160/232 |
| 2,583,878 | 1/1952 | Plym | 160/235 |
| 2,739,730 | 3/1956 | Jonas | 220/350 |
| 2,951,533 | 9/1960 | Lucas et al. | 160/232 X |
| 3,437,126 | 4/1969 | Schroeder | 160/235 |
| 4,126,173 | 11/1978 | Theuerkauff | 160/236 V |
| 4,128,120 | 12/1978 | Frey | 160/235 X |
| 4,275,667 | 6/1981 | Hilton | 217/62 X |
| 4,432,591 | 2/1984 | Rinkewich | 160/235 |

FOREIGN PATENT DOCUMENTS

| | | | |
|---|---|---|---|
| 164161 | 11/1954 | Australia | 160/235 |
| 17374 | 8/1917 | France | 160/235 |
| 567822 | 3/1924 | France | 160/235 |
| 243853 | 12/1925 | United Kingdom | 160/235 |
| 860140 | 2/1961 | United Kingdom | 160/235 |

*Primary Examiner*—Allan N. Shoap

*Attorney, Agent, or Firm*—Frost & Jacobs

[57] ABSTRACT

A shutter of the type used as a closure for boxes or containers, or for garage doors, includes a series of interconnected elongated strips having at each end of each strip an integral male and female connecting member so that the female connecting members of one strip are capable of interlocking with the male members of an adjacent strip to form the shutter. Each strip also includes an elongated recessed area and a corresponding overlapping portion positioned below the recessed area. When a series of strips are interconnected to form the shutter, the overlapping portion of one strip is received in the recess portion of an adjacent strip. Lastly, each strip includes at least one vertically oriented pair of tongue and groove members positioned intermediate the ends of each strip so that when a series of strips are interconnected to form a shutter, the tongue of one strip is received by the groove of a corresponding strip so as to prevent tampering. The strips can be injection molded from plastic material and can include metal reinforcement members extending longitudinally within the strip.

6 Claims, 5 Drawing Figures

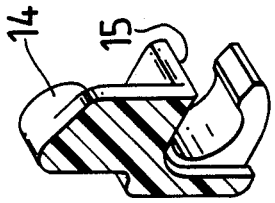
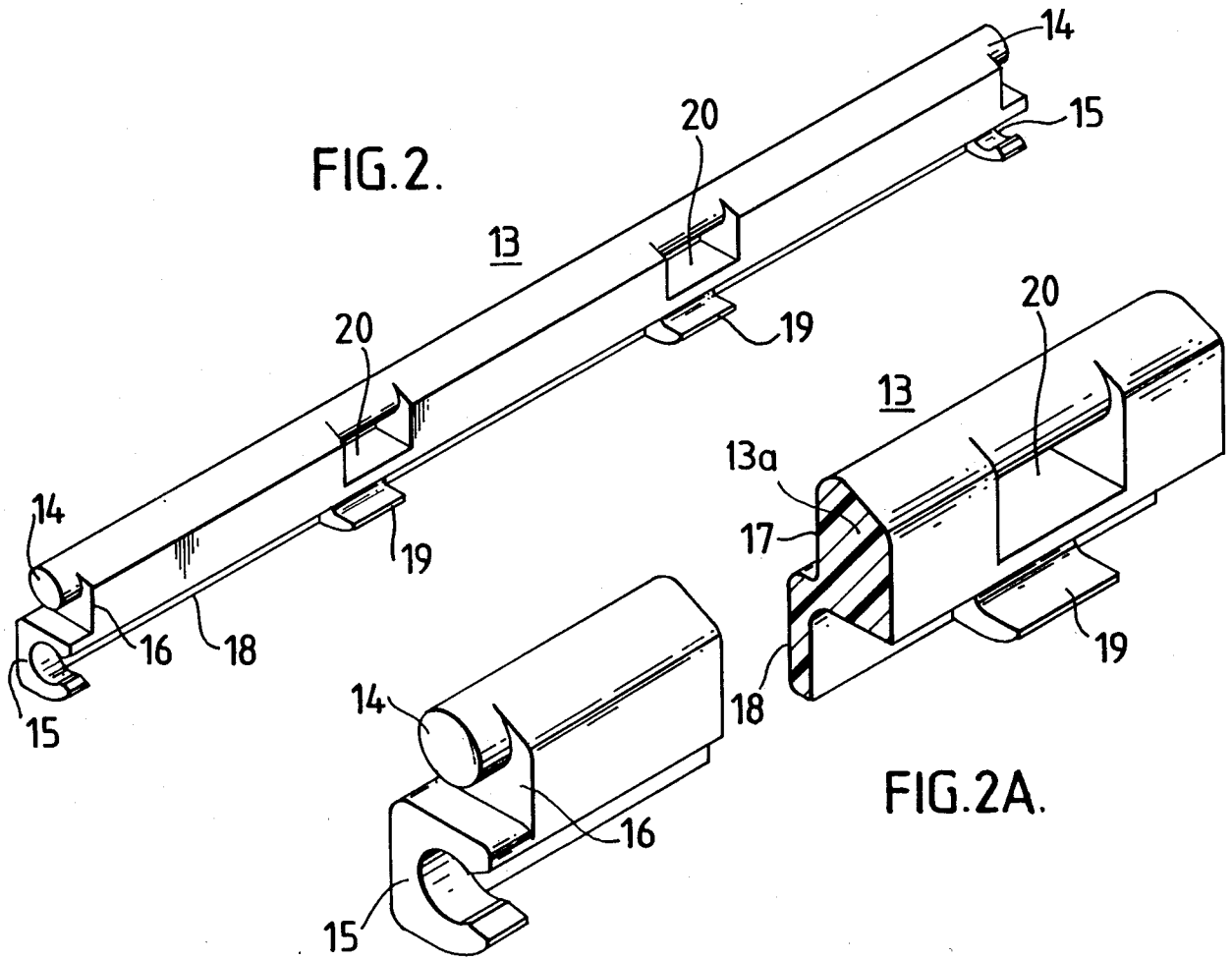
FIG. 2.
FIG. 2A.

INJECTION MOULDED SHUTTER

BACKGROUND OF THE INVENTION

This invention relates to a shutter of the kind which comprises a series of interconnected strips which extend laterally of the shutter so as to provide a flexible form of shutter or door capable of negotiating bends during its opening and closing operation. Shutters of this kind are used as closures for boxes and containers such as cassettes containing bank notes, vertical filing cabinets, and for doors for garages, lock-up shops etc.

SUMMARY OF THE INVENTION

An object of this invention is to provide a shutter which is inexpensive to manufacture, has a minimum of parts, and is substantially tamper-proof when used in appropriate circumstances such as when used as a cassette door.

In accordance with the present invention there is a flexible shutter comprising a series of interconnected strips which extend laterally of the shutter, each strip having at each end integral male and female connecting members whereby the strips may be joined in series to form the shutter, each strip also comprising a recess running the length of the strip adapted to receive a corresponding overlapping portion of an adjacent strip. The strips are preferably individually formed by injection moulding.

Preferably the individual strips are formed from plastics material.

The strips may be reinforced by embedding reinforcement wires or reinforcement strips in the individual injection moulded plastic strips.

Each of the strips may be formed with a protruding tongue and a recess so positioned that when the strips are joined at their ends the tongue of one strip enters the recess of an adjacent strip so as to interlock the strips to prevent tampering and to allow flexibility of the strips.

Preferably also the male and female connecting members are formed adjacent shoulders at the ends of the strips so that when the male and female connecting members are engaged relative lateral movement of the strips is prevented.

The shutter may be used as the door of a cassette, particularly a cassette intended to contain bank-notes, and in this case the ends of the strips forming the shutter are preferably engaged in guides at each side of the cassette so that the male and female connecting members are totally enclosed within the guides.

BRIEF DESCRIPTION OF THE DRAWINGS

In the accompanying drawings:

FIG. 2 shows one of the injection moulded strips which will form the shutter door;

FIG. 2A shows an enlarged view partly in section of the same strip;

DESCRIPTION OF THE PREFERRED EMBODIMENT

Figure 1:
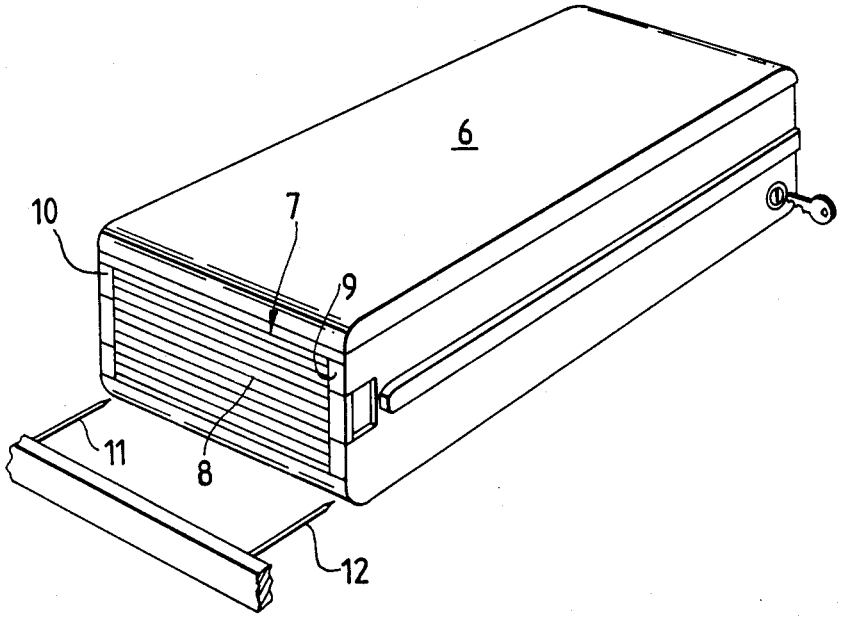
FIG. 1 is an isometric view of a bank note cassette having a shutter door made in accordance with the invention.

The bank note cassette shown in FIG. 1 is shown in more detail in our published UK Patent Specification No. 2039264A.

The cassette is in the form of a strong box 6 which has at one end a shutter 7 formed of a number of strips 8 made in accordance with the invention. The lateral ends of the strips forming the shutter are engaged in guides 9 and 10 at the sides of the cassette when the shutter is closed. the guides are made of U-shaped sections so as to receive the ends of the shutter.

The cassette is arranged so that when it is put into an appropriate machine 1 a pair of rods 11 and 12 enter The cassette and operate the mechanism to open the shutter.

The full details of this cassette will not be described but they may be obtained by reference to our published UK Patent Specification No. 2039264A.

In FIGS. 2 and 2A is shown a single moulded plastic strip adapted to form a shutter in accordance with the invention. In FIG. 2A the strip 13 is shown broken into three parts for convenience of illustration but it will be appreciated that the three parts are injection moulded to form a single unitary strip with integral male and female connecting members 14 and 15 at each end of the strip as shown in FIG. 2. These connecting members are formed adjacent a shoulder 16 so that when the connecting members are joined together, the shoulder 16 prevents relative lateral movement of the strip because the inner surfaces of the female members 15 engage the shoulders 16 on adjacent strips. Throughout the length of the strip is formed an overlapping portion 13*a* having a recess 17 (FIG. 2*a*) and a corresponding extension portion 18 so that when the strips are engaged to form a shutter, the portions 18 lie in adjacent recesses 17 on adjacent strips, thus forming a uniform shutter surface and preventing or substantially preventing tampering with the shutter.

Figure 3:
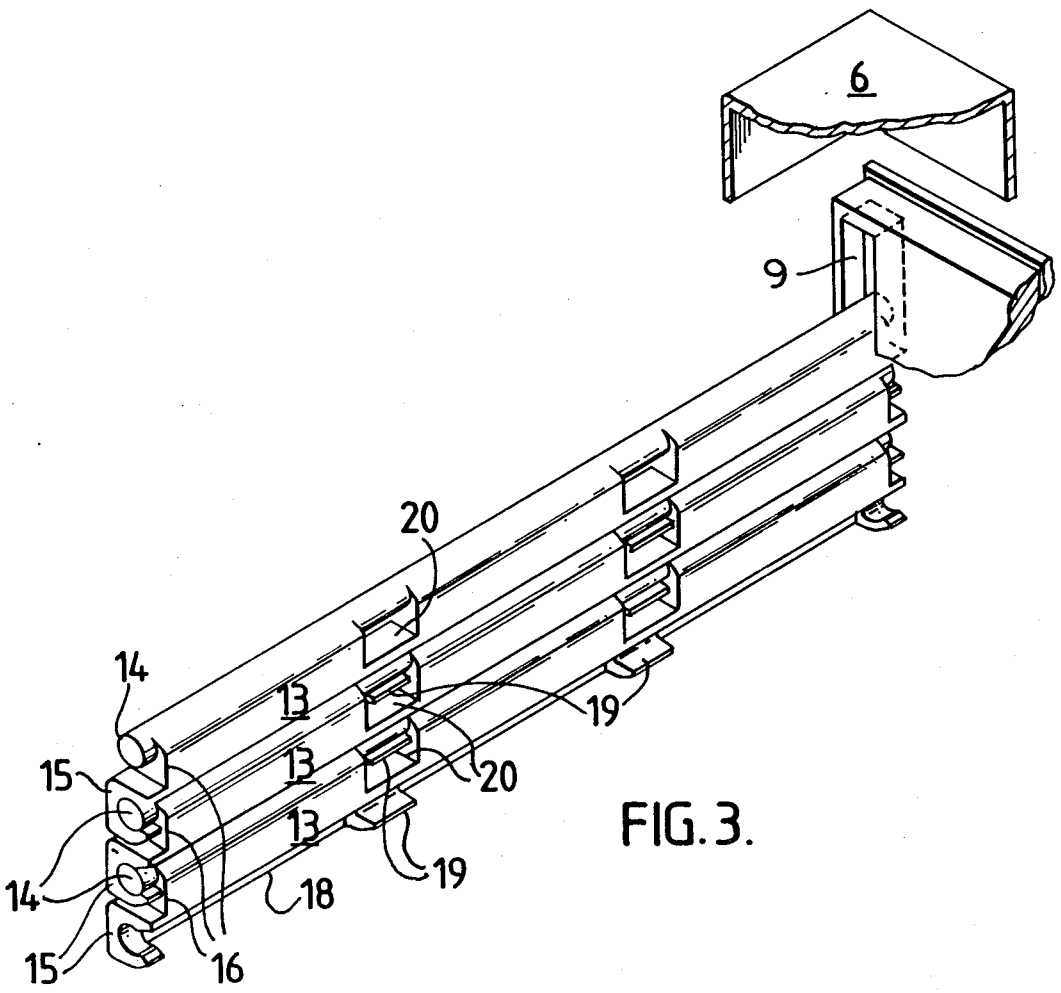
FIG. 3 shows the way in which the individual strips of FIG. 2 are assembled to form a shutter.

To further strengthen the shutter and to assist in preventing tampering, tongues 19 are formed on each strip with corresponding recesses 20 so that when the strips are joined together the tongues 19 of all the strips engage in recesses 20 of adjacent strips. This is best seen in FIG. 3 where several of the strips have been joined together by engaging the male and female inter-connecting members at their ends. The formation of the connecting members is such as to allow flexibility of the shutter, security in joining the strips to form the shutter, and restriction of relative lateral movement of the strips.

When the shutter is used as the door of a cassette of the type shown in FIG. 1 of the drawings, the male and female interconnecting members 14 and 15 will be totally contained within the U-shaped guides 9 and 10, which extend around the bend at the front top edge of the cassette and into the area below the lid of the cassette.

Figure 4:
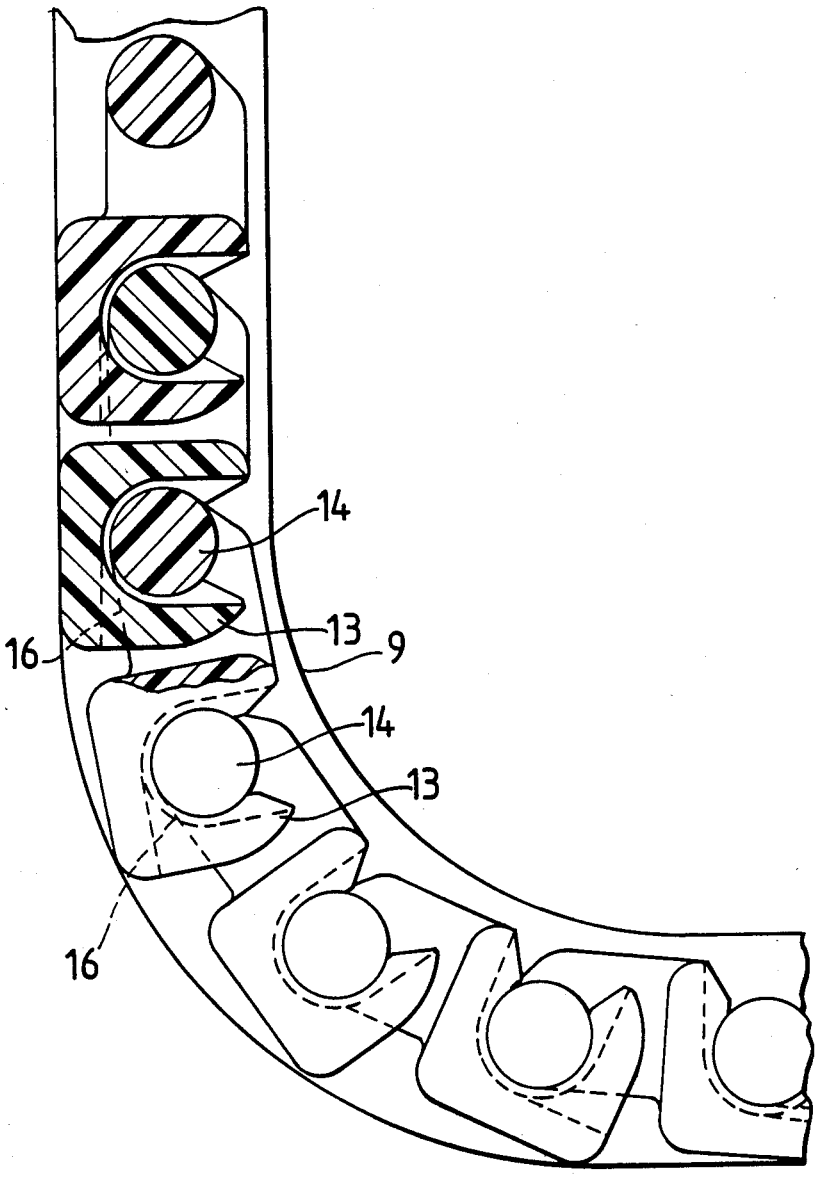
FIG. 4 is a section through one end of an assembled shutter illustrating the interengaging male and female portions which are enclosed within a guide on the cassette.

A portion of the guide 9 is shown in FIG. 3 and also somewhat diagrammatically shown in FIG. 4 with one end of the shutter contained within the guide. Portions of the ends of the strips forming the shutter are shown broken away and in sections to illustrate the way in which the male and female members are contained totally within the guides 9 and 10 and to illustrate the way in which the strips bend to follow the contour of the guides.

Because the male and female members at the ends of the shutter are contained within these guides and can be dimensioned so as to be very close fitting with virtually no play, the wear on the shutters is restricted.

Also, by enclosing the interconnecting male and female members totally in the guides, it is very difficult for them to become disconnected or for anybody to attempt to disconnect them by tampering with the shutter.

The injection moulded plastic strips are very inexpensive, and thus, the total cost of producing a shutter may be reduced by making use of this invention.

The material used for the injection moulding of the strips is preferably glass filled acetal or nylon.

I claim:

1. A flexible shutter comprising a series of interconnected injection moulded plastic strips, each strip having at each end integral male and female connecting members, and are formed so as to permit joining the strips in series to form the shutter, said integral male connecting members comprising a cylindrical projection extending longitudinally from each end of said strip, and each of said integral female connecting members being positioned below each of said integral male connecting members and comprising a C-shape element that projects laterally of said strip so as to receive the cylindrical projection of the male connecting member of an adjacent strip, each strip also having along its entire length a recess portion and a corresponding overlapping portion positioned adjacent said recess portion, each recess portion being offset from the adjacent overlapping portion of said adjacent strip, whereby the corresponding overlapping portion of one strip is designed to be received within the recess portion of an adjacent strip, and each of said strips including intermediate its ends a tongue and groove positioned so that when the strips are joined in series with their respective ends substantially aligned to form the shutter, said tongue of one strip enters the groove of an adjacent strip so as to interlock the strips to prevent tampering and to allow flexibility of the strips, said tongue of each of said strips extending laterally of the strip in the same direction as said C-shape element projects and being positioned on said strip on an extension, said extension being the length of the strip and extending from said overlapping portion offset therefrom in substantially the same plane as the recess to thereby define said recess with said overlapping portion, being positioned on said corresponding overlapping portion aligned with the corresponding tongue on said strip and the adjacent strip.

2. A flexible shutter according to claim 1 and in which the strips are reinforced by embedding reinforcement members in individual injection moulding plastic strips.

3. A flexible shutter according to claim 1 and in which each strip is formed with shoulders at both ends of the strips and the male and female connecting members are formed adjacent the shoulders at the ends of the strips so that when the male and female connecting members are engaged relative lateral movement of the strips is prevented by the shoulders.

4. The flexible shutter claimed in claim 1 in combination with a cassette defining an enclosure having a rectangular opening therein adapted to be closed by said shutter, said opening having guides extending along its opposite side edges, the ends of the strips forming said shutter being engaged in said guides so that the male and female connecting members are totally enclosed within said guides.

5. The flexible shutter of claim 1, wherein said strips are solid along their entire length.

6. The flexible shutter of claim 1, wherein said recess portion is substantially thicker than said corresponding overlapping portion in each of said strips.

* * * * *